United States Patent [19]

Wenderoth et al.

[11] 4,411,542

[45] Oct. 25, 1983

[54] ERROR RIBBON ELEVATION AND TRANSPORT MECHANISM FOR TYPEWRITERS AND SIMILAR MACHINES

[75] Inventors: Karl Wenderoth, Bad Vilbel; Lothar Kuhn, Frankfurt, both of Fed. Rep. of Germany

[73] Assignee: Triumph-Adler A.G. fur Buro- und Informationstechnik, Nuremberg, Fed. Rep. of Germany

[21] Appl. No.: 313,457

[22] Filed: Oct. 21, 1981

[30] Foreign Application Priority Data

Dec. 23, 1980 [DE] Fed. Rep. of Germany ..... 3048810

[51] Int. Cl.[3] ..... B41J 29/36; B41J 33/18

[52] U.S. Cl. ..... 400/697.1; 400/212; 400/236.1

[58] Field of Search ..... 400/211, 212, 214, 220, 400/236.1, 236, 697.1, 697

[56] References Cited

U.S. PATENT DOCUMENTS 3,880,271 4/1975 Hebron ..... 400/212

3,997,046 12/1976 Wolowitz ..... 400/697.1

FOREIGN PATENT DOCUMENTS 1911122 9/1970 Fed. Rep. of Germany ... 400/236.1

2030076 4/1980 United Kingdom ..... 400/212

OTHER PUBLICATIONS

"Erase Ribbon Life and Advancing Mechanism"; Mathews, R. D.; *IBM Technical Disclosure Bulletin;* vol. 19, Number 7; Dec. 1976; p. 2393.

*Primary Examiner*—Paul T. Sewell

*Assistant Examiner*—David A. Wiecking

*Attorney, Agent, or Firm*—Joseph R. Spalla

[57] ABSTRACT

Disclosed is a mechanism so arranged that a relatively weak power source can be employed to effect error ribbon elevation and incremental feed. A bridge which is pivotably mounted on a frame carries a rotatably mounted ratchet and a pivotably mounted pawl which, when the bridge is rotated by a magnet to elevate the bridge, is caused to react with a frame part and pivot relative to and to drive the ratchet to feed ribbon.

2 Claims, 3 Drawing Figures

ERROR RIBBON ELEVATION AND TRANSPORT MECHANISM FOR TYPEWRITERS AND SIMILAR MACHINES

This invention relates to mechanism for a correction ribbon in typewriters or similar machines; more particularly it relates to mechanism having a single power source for elevating and transporting a ribbon; and specifically to mechanism where the power source is an electromagnet.

To make a correction, correction ribbons must be raised and lowered. In addition, they must be transported by an increment in order to bring an unused part of the ribbon into typing position before the next correction. According to the state of the art, more or less costly mechanisms are known to accomplish this. For instance, DE-AS No. 23 31 080 shows a correction mechanism which consists of a great many components. If such a mechanism is used in an electronically controlled typewriter, additional drives such as motors and/or magnets are necessary, such as disclosed in copending application Ser. No. 267,929 of Manfred Link filed May 28, 1981, titled Error Correction Typewriter Ribbon Systems, wherein one motor and one magnet are employed to raise and transport the carbon ribbon in addition to the correction ribbon.

In accordance with the present invention, a single electromagnet serves to elevate an error ribbon support bridge which carries a pawl and take up spool drive ratchet. The pawl motion for the transport of the correction ribbon comes about automatically as a reaction to movement of the bridge so that no additional drive for the pawl is needed.

It is an object of the invention to simplify a mechanism for elevating and feeding correction ribbon so that a simple and relatively weak magnet suffices for both elevating and transporting the correction ribbon.

It is another object of the invention to simplify the known arrangements so that a considerable reduction in the number of components parts results.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
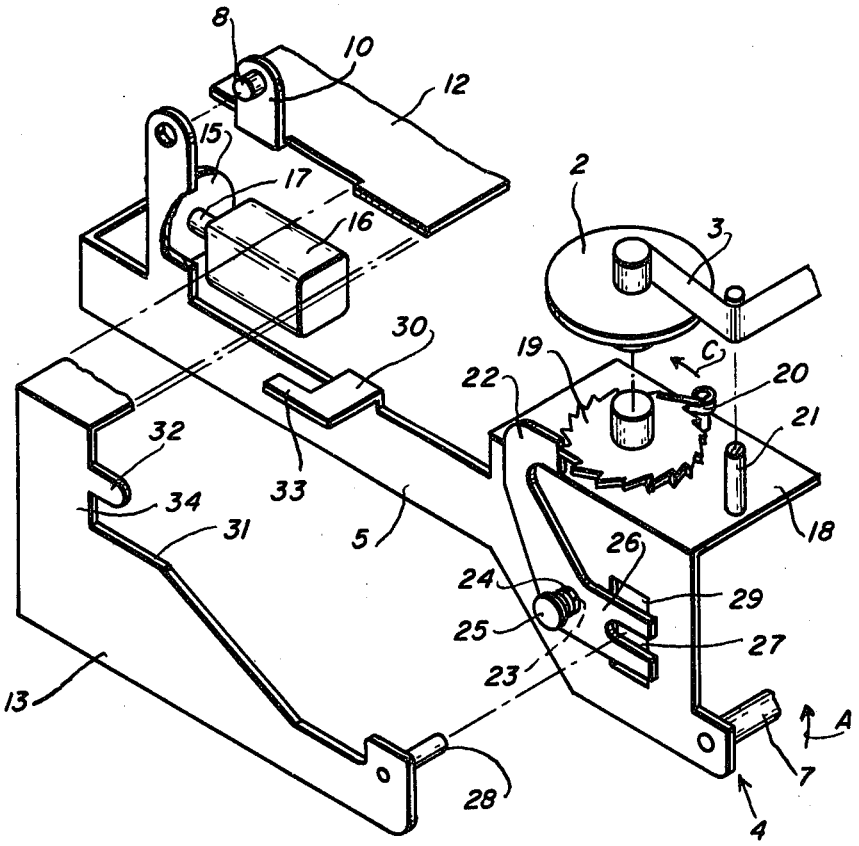
FIG. 1 is a partial perspective view with parts broken away of salient elements of the invention.
Figure 2:
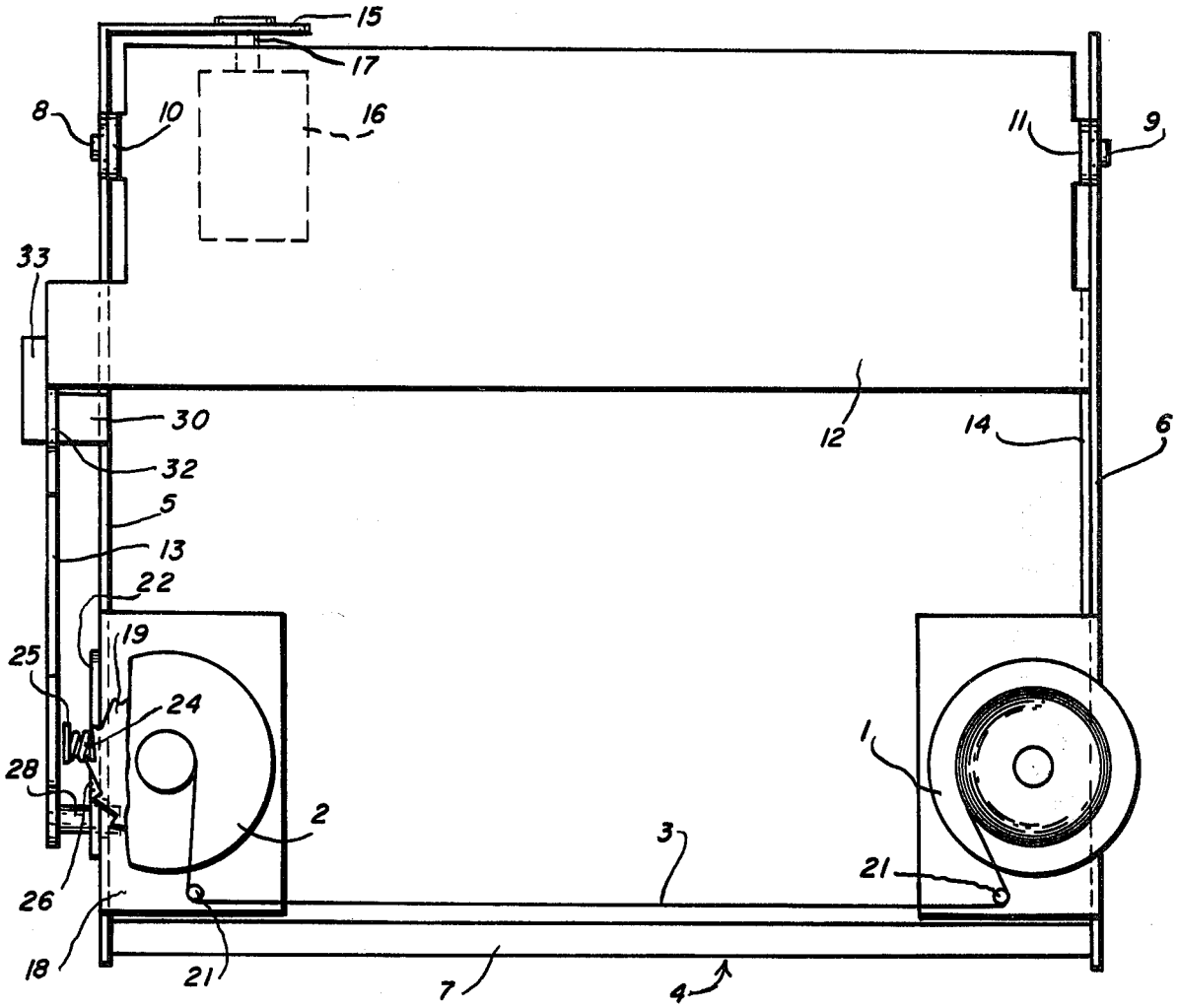
FIG. 2 is a top view of the error correction ribbon mechanism of the invention.

Referring now to the drawings there is shown in FIG. 2, a supply spool 1 as well as a take up spool 2 for a correction ribbon 3 disposed on a bridge generally designated by reference numeral 4 which consists of two side webs 5 and 6 connected by a cross bar 7. The bridge 4 is pivotably mounted on two outwardly directed pivot pins 8 and 9 located on tabs 10 and 11 extending upwardly from a plate 12 having forwardly extending side arms 13 and 14. The plate 12 may be designed, for example, as the frame of a printing head carriage and serve at the same time as the support for a carbon ribbon cassette (not shown). For reasons of clarity the plate 12 is shown in dash dotted lines and broken off in FIG. 1 but is shown in full lines in FIG. 2.

With particular reference to FIG. 1 an electromagnet 16 has an armature 17 adapted upon energization to attract a bent off tab 15 of the side web 5 of the bridge 4 thereby to pivot the bridge 4 in the direction of arrow A about pivots 8 and 9. The magnet because energized when a correction key (not shown), but known per se, is actuated.

At its free end the side web 5 of the bridge 4 has a bent off section 18 providing a platform on which a ratchet wheel 19 is rotatably mounted and which is associated with a spring detent 20 to prohibit its backward motion. The take up spool 2 for the correction ribbon 3 is mountable on and for rotation with the ratchet wheel 19 in known manner. As shown in FIG. 2 it is expedient to lead the correction ribbon 3 from the supply spool 1 to the takeup spool around guide posts 21. The arrangement on the other side of the bridge 4 supporting the supply spool 1 of the correction ribbon 3 is similar.

In accordance with the invention; a pawl 22 is pivotably mounted about a pivot pin 23 below the bent off section 18 on the side web 5 of the bridge 4. In the upper area, in which the pawl 22 extends to engage the ratchet wheel 19, the pawl 22 can move axially of its pivot pin 23. A spring 24 mounted on the pivot pin 23 between a head 25 formed on the pin 23 and the side web 5, tends, however, to axially urge the pawl 22 in position for constant engagement with the ratchet wheel 19. The pawl 22 is of angular design and its lower arm 26 has a forked end 27. A pin 28 fastened to the side arm 13 of the bearing plate 12 projects into and through the forked end 27. Behind the arm 26 there is, on the side web 5 of the bridge 4, a recess 29 which makes it possible for the bridge 4 to be pivoted about the pivot pins 8 and 9 without colliding with the pin 28.

On the side web 5 of the bridge 4 a bent tab 30 is provided which, in the rest position of the bridge 4, rests on the edge 31 of the side arm 13 of the bearing plate 12. This limits the lower position of the bridge 4. The upper limit is provided by a protrusion 32 disposed above the edge 31 on the side arm 13 of the bearing plate 12, likewise interacting with the tab 30 of the side web 5 of the bridge 4. The upper travel limit of bridge 4 is adjustable by bending the tab 30 up or down. The tab 30 is also provided with a lug 33 which grips around the side arm 13 laterally, roughly at a point 34 on the side arm 13. This guides the bridge 4 and prevents its movement laterally. Such a motion of the bridge 4 would be restricted in the one direction, to the right as viewed, by the lug 33 encountering point 34 and towards the other side, to the left, by the side web 5 encounting the side arm 12. If, as described earlier, a correction operation is initiated, the electromagnet 16 becomes energized. Its armature 17 pulls on the tab 15 of the side arm 5 of the bridge 4, pivoting it out of the lower rest position in the direction of arrow A until the bent tab 30 of the side web 5 contacts the protrusion 32 of the side arm 12. This moves the correction ribbon 3 to the level of a typed line.

Figure 3:
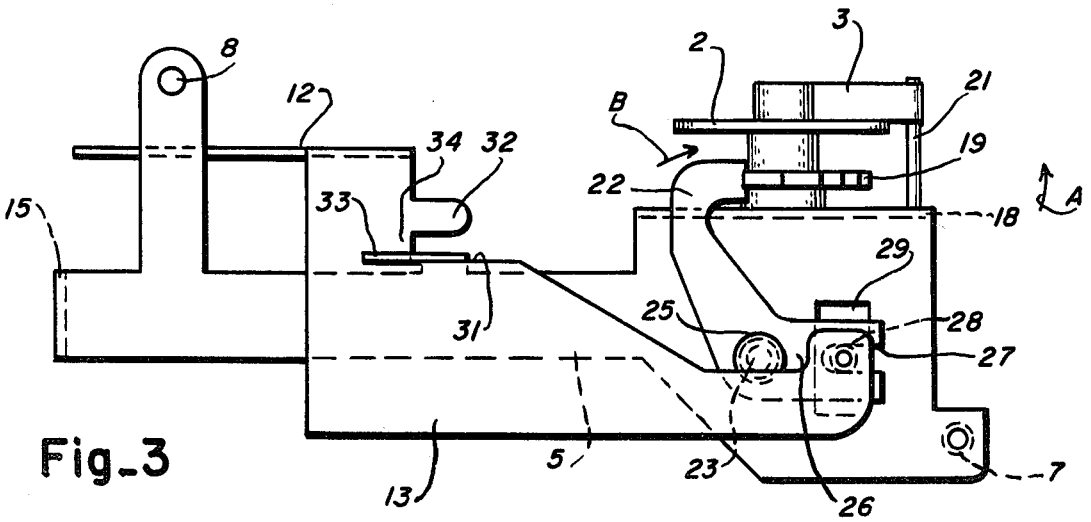
FIG. 3 is a side elevational view showing elements of the error correction ribbon mechanism shown in FIG. 1.

The pivoting motion of the side web 5, furthermore, causes the pawl 22 to perform a pivoting motion in the direction of arrow B (FIG. 3). This is brought about by the fact that the arm 26 of the pawl 22 reacts against the stationary pin 28 by means of its forked end 27. The effect of the pivoting motion of the pawl 22 in arrow direction B is that the ratchet wheel 19 is turned by a certain amount in arrow direction C (FIG. 1) during the up stroke of the bridge 4. This causes the correction ribbon 3 to wind up on the windup spool 2. As long as the bridge 4 is in its raised position, the pawl 22 remains in its pivoted position also. After the conclusion of a correction sequence the electromagnet 16 is deenergized so that the bridge 4 with the correction ribbon 3 returns to its basic position with the tab 30 resting on the edge 31 of the side arm 13 of the bearing plate 12. In this process, the pawl 22 is also returned to the position shown in FIG. 3. In so doing, the pawl 22 moves axially in retracting over one or more teeth of the ratchet wheel 19, countering the force of spring 24. The already mentioned detent spring 20 will prohibit unintentional turning of the ratchet wheel 19 opposite to arrow direction C. After the pawl 22 has returned to its starting position, the spring 24 restores it again into its ready position relative to the ratchet wheel 19.

As is evident from the specification and the drawing, a single electromagnet 16 suffices to lift and transport the correction ribbon 3 in a mechanism according to the invention. Due to the fact that only a few parts have to be moved, the electromagnet 16 can be relatively weak. In most cases, the bridge 4 requires no return spring because the mass is sufficient to return the mechanism into its basic position when the electromagnet 16 is deenergized. However, in certain cases an additional return spring may be provided in a suitable spot on the bridge 4, tending to cause the tab 30 to contact the edge 31.

The invention claimed is:

1. In a typewriter having print and error correction ribbons, a frame for supporting said print ribbon, a bridge pivotally mounted on said frame for supporting error correction ribbon supply and take up spools, an error correction ribbon take up spool feed ratchet rotatably mounted on said bridge, an electromagnet connected to pivot said bridge when energized thereby to effect elevation of said error correction ribbon, a pawl pivotally mounted on said bridge for driving said feed ratchet when pivoted, said pawl having a forked end, and a pin on said frame extending through said pawl forked end for causing said pawl to pivot into driving engagement with said feed ratchet as said bridge is pivoted by said electromagnet thereby to effect feed of said error correction ribbon.

2. In a typewriter as recited in claim 1, including cooperating formations on and integral with said frame and said bridge for establishing the lower and upper limits of pivotal movement of said bridge.

* * * * *